United States Patent [19]

Roper et al.

[11] 4,411,187

[45] Oct. 25, 1983

[54] COMPOSITE MARIMBA BARS

[76] Inventors: Daleth F. Roper, 418 W. Evergreen Ave., Monrovia, Calif. 91016; Lowell H. Montz, 1470 27th Ave., Sacramento, Calif. 95822

[21] Appl. No.: 325,205

[22] Filed: Nov. 27, 1981

[51] Int. Cl.[3] ..... G10D 13/08

[52] U.S. Cl. ..... 84/402; 84/403

[58] Field of Search ..... 84/402–409

[56] References Cited

U.S. PATENT DOCUMENTS

| | | | |
|---|---|---|---|
| 1,653,794 | 12/1927 | Whitehorn | 84/409 |
| 1,727,238 | 9/1929 | King | 84/402 |
| 2,489,400 | 11/1949 | Cooley | 84/409 |
| 2,834,243 | 5/1958 | Miessner | 84/408 |
| 3,483,786 | 12/1969 | Heninger et al. | 84/403 |
| 4,058,044 | 11/1977 | Murakami | 84/403 |

*Primary Examiner*—Lawrence R. Franklin

*Attorney, Agent, or Firm*—Wagner & Bachand

[57] ABSTRACT

This invention relates to improved percussion musical bars for xylophones, marimbas, bar bells, orchestra bells, vibraphones etc. Traditionally, music played on a marimba, for example, is of one type in the lower octaves denoted by a longer sustained sound, and of a different type in the upper octaves, where a smooth sustained sound is difficult or nearly impossible to maintain due to the rapid decay of the sound emanated from the bars in that range. In this invention, vibraile musical bars made of dissimilar materials, such as wood and metal, wood and rubber, metal and plastic, metal and rubber etc., in the form either a composite or laminations to control the decay period of sounds originating from various bars and to obtain a nearly uniform decay period for all tonal elements in a multi-octave instrument. The proportionate thickness of each dissimilar material in the improved musical bars depends on the shape and cross-section of the bar, the tone-element of concern and the desired decay period.

10 Claims, 11 Drawing Figures

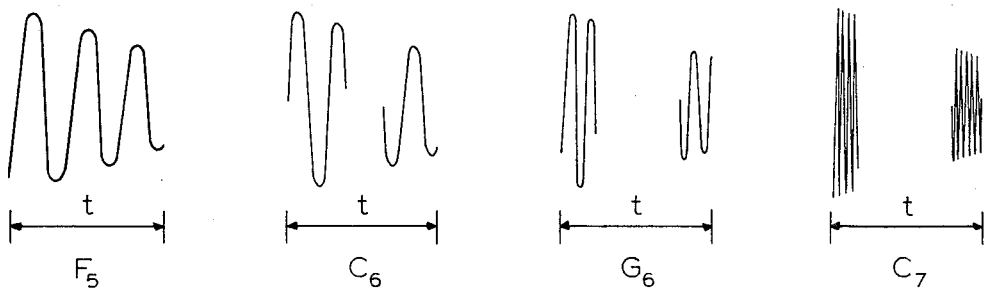
Fig. 1A
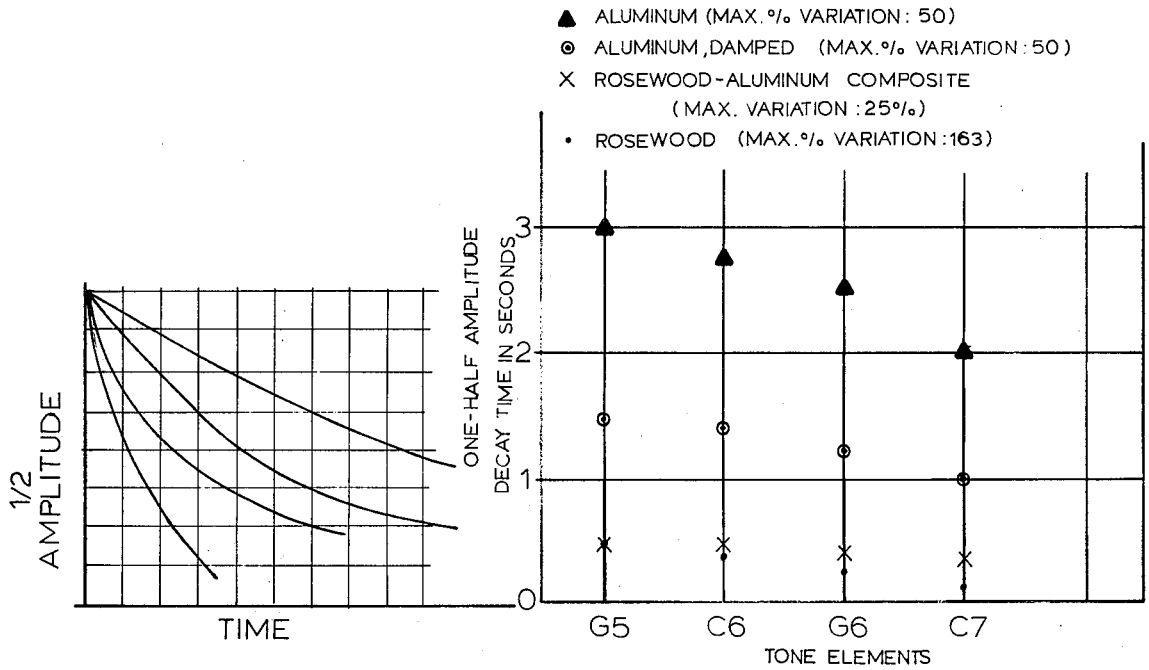
Fig. 1C
Fig. 1B
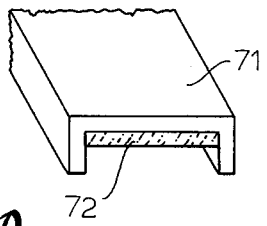
Fig. 7A
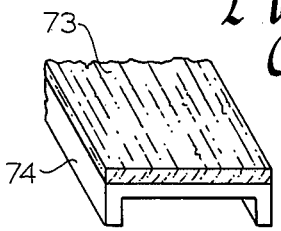
Fig. 7B

COMPOSITE MARIMBA BARS

BACKGROUND OF THE INVENTION

This invention is in the field of percussion-type musical instruments and relates to improvements in musical bars with means to control their ringing decays or sustain period, and to obtain a nearly uniform ringing decay of sounds emanated from such bars in a multi-octave instrument.

It is often desirable in musical bars to control the decay periods of the tone elements. Non-percussion musical instruments, such as violins, woodwinds, horn, etc., have controlled decay, that is, a sustained sound. In case of a violin, for example, the decay period is limited by the length of the bow and the speed with which the bow is drawn across the string. In the case of wind instrument, on the other hand, the decay period is controlled by the supply of air in the lungs of the instrument players. The pipe organ has an almost unlimited air supply and therefore an almost unlimited sound sustaining possibility.

Percussion instruments, by contrast, have inherently variable decay periods, which range from about 30 seconds for the lowest note and to ½ second for the highest note in a piano. A xylophone has approximately one second to 1/50 second variable decay period from the low to the high end. Similarly, a marimba bar has a variable decay period of two seconds to 1/50 second from the tenor C in the bass clef to C7, a range of four octaves. Traditionally music played on a marimba in the lower octave has a longer sustained sound because of the slower decay period than that of the upper octaves, where a smooth sustained sound is difficult or nearly impossible to maintain due to the rapid decay of tone elements in that range. For that reason the music played in that range is usually of a more rapid tempo. The solution in the past has been to accept this difference. If the decay periods of the tone elements in the low and high octaves could be made approximately the same, the musical repertoire of marimbas would be greatly enhanced.

It is well known in the musical arts that the vibraphone using tempered aluminum tone bars has the most consistent decay period of all percussion instruments, the decay period being 30 seconds in the low end to about 6 seconds in the high end for a 3 octave instrument. This sustaining tone characteristic, however, is too long to use in rapid note sequences. A damper operated by a foot pedal may be used in such a case to limit the note sequences to the speed of the damper pedal. The vibraphone is used for rapid musical passages, by means of leaving the foot damper closed, thus preventing the full vibration responses of the bars. The tonal timbres in the "damper on" and "damper off" positions, however, are different.

The decay period of the marimba is short enough to permit the play of rapid passages and slow enough for sustained tones in the lower octaves. But this period is too short for effective sustained tones in the upper octaves.

BRIEF STATEMENT OF THE INVENTION

Faced with this state of the art, one objective of my invention is to bring the decay period in marimba bars to more uniformity between the high and low octaves, that is, from approximately the middle range of a rosewood tone bar marimba to the highest tone, C7 or F7, I have completed this objective by means of combining two or more dissimilar materials with selective proportionate thickness for each material to satisfy the tonal requirement and the desired decay period.

From a theoretical standpoint, the relationship between the selection and preparation of materials may be analyzed and better understood. The displacement in a struck bar has a peak value shortly after the force is applied to the bar. Thereafter, the displacement amplitude decays with time. In general, this decay is exponential, in the form of $e^{-at}$ where t is the time and a is the exponential coefficient. The value of a depends on the energy losses in the bar or the equivalent mechanical resistance to free vibration of the bar. In a vibrating bar, these losses are due to the mechanical losses at the supports and within the bar in the form of heat, and due to the acoustical radiation from the bar. The coefficient a is different for different materials. For example, normally a bar made of aluminum or brass has a value of a much lower than that of rosewood. One can also modify the value of a by using a composite or laminations of two or more dissimilar materials, such as wood and metal, wood and rubber, metal and rubber, metal and plastics, etc. Such a modification of the value of a is effected in the present invention.

It may be noted that the use of dissimilar materials to control the ringing decay period for a musical bar and to obtain thereby a nearly uniform decay period for all bars in a multi-octave musical instrument is not arbitrary. If, for example, rosewood and brass are chosen as the two dissimilar materials for a composite or laminated bar, the proportionate thickness of each material will also depend on the shape and cross-section of the bar, the required tone to be emanated from the bar and the desired decay period.

Aside from providing a nearly uniform ringing decay period, the composite or laminated bars permit the use of the same pair of mallets for all bars in a multi-octave percussion instrument. One can thus use the same pair of mallets for a 4-octave marimba, ranging from C3 to C7. This feature is far preferable than the prior burden of using hard mallets on the top octaves and changing to soft mallets for the lower octaves while playing.

Further objects and advantages of the invention will become apparent from the study of the following portion of the specification, the claims and the attached drawings.

BRIEF DESCRIPTION OF THE DRAWINGS

FIG. 1A are graphical representations of the acoustic characteristics of the bars of FIG. 2; for various tone elements.

FIG. 1B is a graphical presentation of the acoustic ringing characteristics of identically tuned bars, of aluminum (damped and undamped), rosewood, and a composite of aluminum and rosewood.

FIG. 1C is a characteristic representation of the decay of several bar materials.

FIG. 7A shows still another type of a musical bar made of metallic section, with a cross-section similar to that of an inverted channel at the top, affixed in a vertical bond to a wooden strip inside the channel.

FIG. 7B shows another type of musical bar made of a metallic section, with a cross-section similar to that of an inverted channel at the top, affixed in a vertical bond to a wooden section of a rectangular cross-section.

DETAILS OF THE INVENTION

Figure 1:
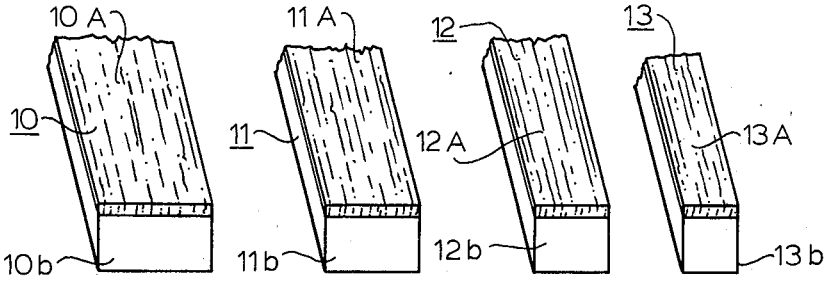
FIG. 1 is a fragmentary perspective view of an array of vibratile musical bars each having a different fundamental tone but similar decay characteristics. The bars in this case comprise of a composite or laminations of two or more dissimilar materials such as wood and aluminum.

The primary objective of the invention is to provide a nearly uniform ringing decay period for multi-octave vibratile musical bars as illustrated schematically in FIG. 1. Here an array of musical bars 10–13 is shown, each bar comprising a composite or laminations of two or more dissimilar materials including an upper or playing layer 10A–13A and a lower or support layer 10B–13B. In the preferred embodiment of the invention, one of the two dissimilar materials such as the support layer 10B–13B will be a metal such as aluminum, while the other will be a non-metal such as rosewood or one of the newer plastic substitutes, for example, bars sold under the Trademark Kelon produced by Ludwig Industries Inc. of Chicago, Ill.

The ringing decay periods for metals, non-metals and a composite of metals and non-metals are substantially different as best illustrated in FIGS. 1A and 1B.

In FIG. 1A the characteristic decay curves of rosewood, aluminum undamped, aluminium damped and also a curve for a composite of aluminum and rosewood are shown. Aluminum exhibits the longest ringing characteristic when undamped, taking several seconds to decay in amplitude to one half its original value. When damped, aluminum reaches one half amplitude in 1.5 second, rosewood in 0.5 second and a particular composite of aluminum and rosewood in 0.8 second.

According to this invention, one can select appropriate proportionate thicknesses for the metallic and non-metallic segments of the bars such that the combination yields the desired fundamental tone and the desired ringing decay period simultaneously, although the value of the decay period thus realized for composite bars is in between the values of the decay periods for the metal and non-metal. The percentage variations of the decay time for the tone elements G5 through C7 for the composite and non-composite bars are substantially different as is apparent in FIG. 1B. For example, the percentage variations of the decay time for tone elements G5, C6, G6, C7, for aluminum, rosewood and composite bars are 50, 163 and 25 respectively, is apparent in FIG. 1B. Thus the composite bar in accordance with this invention exhibits the lowest percentage variation between the various tones, a quality accomplished with this invention and long sought. Note that the composite exhibits lower variation than either of its components. Although only certain tones are used for illustrations, they are representative for all tone elements. Employing this invention it is possible to produce a multi-octave percussion instrument with minimum variation in decay time which allows the use of a single type mallet throughout the performance.

Table 1 shows the typical bar dimensions, proportionate thicknesses of the metallic and non-metallic segments and the resultant decay periods achievable by the composite bars in a multi-octave musical instrument. It should be noted that the proportionate thicknesses of the two layers A and B of dissimilar materials and the bar dimensions as shown in Table 1 are not unique, since they may vary for different shapes and cross-sections of the bars.

Figure 2:
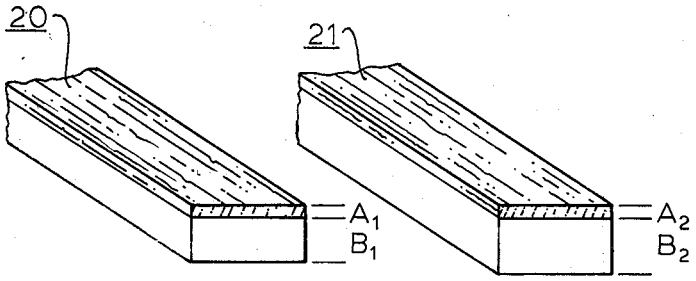
FIG. 2 is a fragmentary perspective showing of typical dimensions and proportionate thicknesses of two dissimilar materials, wood and aluminum in this case, for the two bars constituting tone elements in the low and high octaves.

FIG. 2 shows two examples of relative dimensions and proportionate thicknesses of the two dissimilar materials for two composite bars 20 and 21 constituting tone elements at the low and high octaves and for the rectangular configuration of the bars. This indicates that the thickness of each of the layers 20A and 20B as well as 21A and 21B of dissimilar materials is not arbitrary but depend on the tone element for a given desired decay period.

Figure 3:
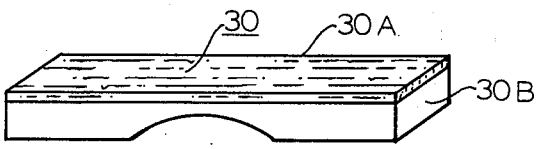
FIG. 3 is a perspective view of an arched musical bar with a section of one material such as wood or plastics at the top and a section of a different material such as a metal at the bottom.

The objective of controlling the decay period for bars in a percussions type musical instrument can also be realized by a number of different configurations of the bars, where each bar is made of two or more dissimilar materials in a composite or laminar form as discussed earlier. One such configuration is shown in FIG. 3, in which bar 30 includes upper layer 30A at the top made of a non-metal such as rosewood or plastic similar to FIG. 1 above, and the lower layer 30B is made of a different material such as a metal. The sections may be affixed to each other by an adhesive bonding or fasteners such as rivets. In addition to using two dissimilar materials, the section 30B of the bar is provided with a concave arch 31 at the underside, approximately at the middle of the bar to extend the ringing period. The use of such arches in homogenous bars for this purpose has been known.

Figure 4:
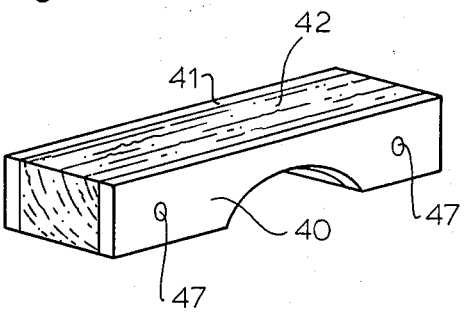
FIG. 4 is a perspective view of another type of musical bar comprising two metal strips affixed at the two sides of a non-metallic bar made of wood or rubber.

FIG. 4 shows another arched configuration of the musical bars, again made of two dissimilar materials. Here two metal strips 40 and 41 are affixed at the two sides of a non-metallic bar 42 made of wood or rubber. The proportionate thickness of each of the metal strips and the non-metallic bar will depend on the tone element, shape or cross-section of the bar and the desired ringing decay period. I have found that side laminar bars have an attractive contrast appearance and allow the use of fasteners 47 in assembly. Magically, they appear to be equally desirable when compared with the other embodiments disclosed.

Figure 5:
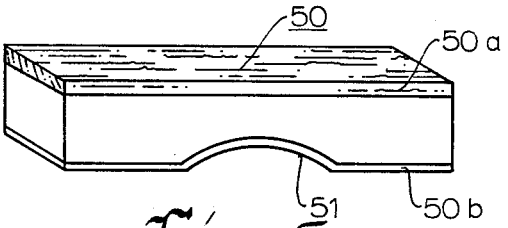
FIG. 5 is a side elevational view by way of illustration an example of another type of bar made of wood or metal having an arch at the middle of the bar and a strip of a different material, including another metal, affixed to underside of the bar covering the arch.

FIG. 5 shows still another configuration of musical bars comprising two dissimilar materials. The bar 50 in this case including an upper layer 50A of wood and is provided with a concave arch 51 approximately at the middle of the bar and at the underside. A strip of metal 50B is bonded to the bar in a bond at the underside, covering the arch 51. Alternatively, the bar could be made of a metal, and a strip of a different material, including another metal, could be affixed at the underside, to achieve the same objective of controlling the decay period.

Figure 6:
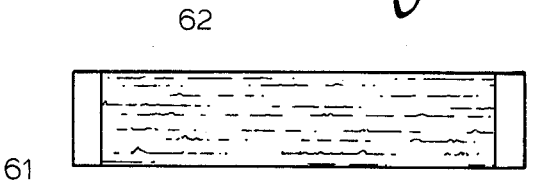
FIG. 6 shows another type of a musical bar made of a metallic section at the bottom affixed to a smaller wooden section at the top in a vertical bond.

FIG. 6 shows another configuration of musical bars comprising of two dissimilar materials to control the ringing decay period. In this case, the bottom section 61 of the bar is made of a metal such as aluminum or brass and a section 62 made of wood and slightly smaller in length than that of the bottom section, is affixed to the bottom section in a vertical bond.

FIG. 7A shows still another configuration of musical bars controlling the decay period wherein the top section 71 is made of a metal, such as aluminum or brass, and has a cross-section similar to that of an inverted channel. The section 72 inside the channel is made of wood and has a rectangular or nearly rectangular cross-section. The top and bottom sections are affixed to each other by a vertical bond. The embodiment of FIG. 7A is a true composite exhibiting the properties as illustrated in FIGS. 1A and 1B above but giving the appearance of an all aluminum bar.

Similarly, FIG. 7B shows a configuration of musical bars controlling the decay period wherein the top section 73 is made of wood and has a rectangular or nearly rectangular cross-section. Affixed to this top section in a vertical bond is an inverted channel shaped metallic section 74.

The channel shapes of FIGS. 7A and 7B provide effective composite bar performance with savings in material in each bar.

The above described embodiments of this invention are merely descriptive of its principles and are not to be considered limiting. The scope of this invention instead shall be determined from the scope of the following claims, including their equivalents.

TABLE I

TYPICAL PHYSICAL DIMENSIONS AND CORRESPONDING RINGING DECAY CHARACTERISTICS OF MUSICAL BARS

| Composite Bar and Octave | Length | Width | Material B Thickness | Material A Thickness | Decay Period |
|---|---|---|---|---|---|
| E5 | 11⅞" | 1½" | ⅜" | 3/16" | ¾ sec |
| D7 | 6¾" | 1⅜" | ½" | 3/32" | ¾ sec |

TABLE I-continued

TYPICAL PHYSICAL DIMENSIONS AND CORRESPONDING RINGING DECAY CHARACTERISTICS OF MUSICAL BARS

| Composite Bar and Octave | Length | Width | Material B Thickness | Material A Thickness | Decay Period |
|---|---|---|---|---|---|
| C#7 | 7" | 1¼" | ½" | ⅛" | ½ sec |

Decay period is defined as the period of time it takes after being struck for the amplitude of vibration to drop to a level of inaudibility. For purpose of developing a standard I use the time for the amplitude to drop to one half of its maximum value. This is illustrated in FIG. 1B.
Material A = Rosewood
Material B = Aluminum 6061

What is claimed is:

1. An array of vibratile musical bars having different fundamental tones and substantially similar ringing decay characteristics, each bar being a composite of a plurality of dissimilar materials and one of said materials having a longer decay characteristic wherein the bar having a higher decay period has a larger content of said one material.

2. An array of vibratile musical bars as in claim 1, wherein said bars are formed from discrete layers of dissimilar materials.

3. An array of vibratile musical bars as in claim 2 wherein said layers are bonded together and act as a single vibratory body at said fundamental tone.

4. An array of vibratile musical bars as in claim 2 wherein said bars constitute a plurality of discrete layers of at least one of said materials and said plurality of discrete layers are bonded to the other of said materials.

5. An array of vibratile musical bars as in claim 2 wherein said bars include a pair of discrete layers of one of said materials bonded with at least one layer of the other of said materials, the combination being capable of vibrating as a single body.

6. An array of vibratile musical bars as in claim 2 wherein the dissimilar materials comprise of a metal and a non-metal.

7. An array of vibratile musical bars as in claim 2 each bar comprising a section of a non-metal, sandwiched between two metal strips affixed to said non-metallic section at the two sides along the length of the bar.

8. An array of vibratile musical bars as in claim 2 each bar comprising a top section made of one of the dissimilar materials and having a concave arch approximately at the middle of this section at the underside, and a bottom section made of the other of said dissimilar materials.

9. An array of vibratile musical bars as in claim 2 each bar comprising a bottom section made of a metal and a slightly smaller wooden top section, affixed to the bottom section in a vertical bond.

10. An array of vibratile musical bars as in claim 2 wherein one of the two dissimilar materials is a metal and has across-section similar to that of an inverted channel, the other dissimilar material having wood of a rectangular cross-section.

* * * * *